US009206663B2

(12) United States Patent
Smith et al.

(10) Patent No.: US 9,206,663 B2
(45) Date of Patent: Dec. 8, 2015

(54) BORE PROTECTOR

(75) Inventors: André M. Smith, Lier (NO); Roar Eide, Oslo (NO); Bengt Dahlborg, Charlottenberg (SE); Magnus Fjørtoft Urke, Oslo (NO); Per Bostedt, Moss (NO); Joachim Vilhelmsson, Ørebro (SE)

(73) Assignee: Aker Subsea AS, Lysaker (NO)

( * ) Notice: Subject to any disclaimer, the term of this patent is extended or adjusted under 35 U.S.C. 154(b) by 196 days.

(21) Appl. No.: 13/978,806

(22) PCT Filed: Jan. 11, 2012

(86) PCT No.: PCT/NO2012/000002

§ 371 (c)(1),
(2), (4) Date: Oct. 23, 2013

(87) PCT Pub. No.: WO2012/096581

PCT Pub. Date: Jul. 19, 2012

(65) Prior Publication Data

US 2014/0034328 A1 Feb. 6, 2014

(30) Foreign Application Priority Data

Jan. 11, 2011 (NO) ..... 20110038

(51) Int. Cl.

| | |
|---|---|
| ***E21B 7/12*** | (2006.01) |
| ***E21B 33/076*** | (2006.01) |
| ***E21B 33/043*** | (2006.01) |
| ***E21B 17/10*** | (2006.01) |

(52) U.S. Cl.

CPC ..... *E21B 33/076* (2013.01); *E21B 17/1007* (2013.01); *E21B 33/043* (2013.01)

(58) Field of Classification Search

CPC ..... E21B 17/1007
USPC ..... 166/351, 338, 358, 368
See application file for complete search history.

(56) References Cited

U.S. PATENT DOCUMENTS 3,837,684 A * 9/1974 Hynes ..... 285/3
4,109,728 A * 8/1978 Sanford ..... 166/382

(Continued)

FOREIGN PATENT DOCUMENTS

NO 323193 B1 1/2007
NO 323194 B1 1/2007
WO WO-2006103477 A1 10/2006

OTHER PUBLICATIONS

Al-Amiri, Thamir J., "International Search Report" for PCT/NO2012/000002, as mailed Apr. 2, 2012, 3 pages.

*Primary Examiner* — Matthew Buck
*Assistant Examiner* — Aaron Lembo
(74) *Attorney, Agent, or Firm* — Winstead PC

(57) ABSTRACT

The invention provides a bore protector for a tubing hanger, the bore protector is to be arranged in a tubing hanger in a spool in a subsea production Xmas tree for through tubing rotary drilling (TTRD) in an existing production well. The bore protector is distinctive in that it comprises a means to be releasably fastened in at least one of: the spool in the Xmas tree and the tubing hanger, and a wear sleeve extending down into the tubing hanger, covering the tubing hanger sealing surfaces for the tubing hanger plugs, the wear sleeve comprises a shoulder at or near an upper end, the shoulder is arranged on a below positioned seat of a main part of the bore protector, in which position the wear sleeve is releasably fastened.

9 Claims, 4 Drawing Sheets

(56) References Cited

U.S. PATENT DOCUMENTS

Figure 1:
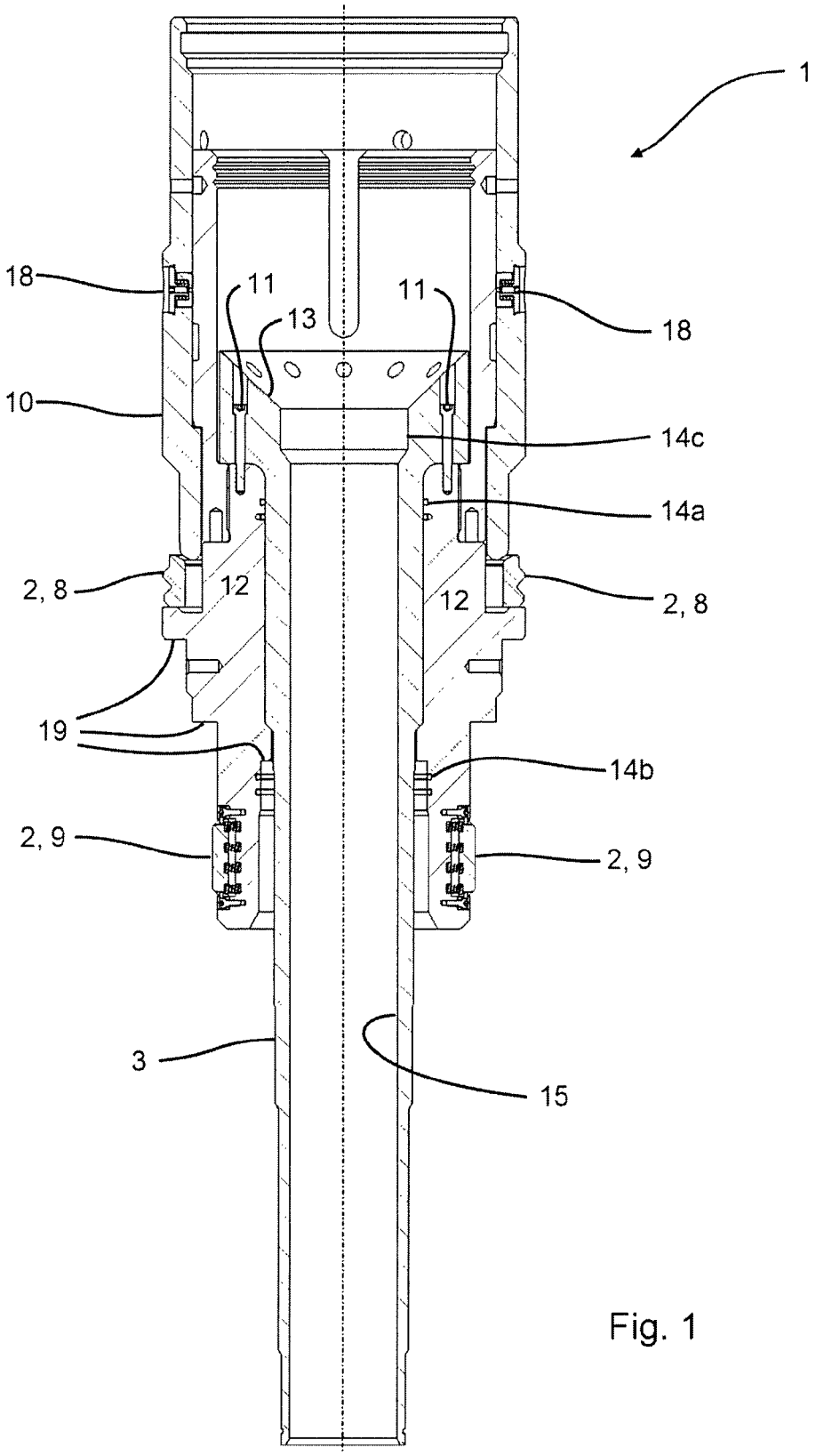

| | | | | | |
|---|---|---|---|---|---|
| 4,691,780 | A | * | 9/1987 | Galle et al. | 166/348 |
| 4,886,121 | A | * | 12/1989 | Demny et al. | 166/382 |
| 5,025,864 | A | | 6/1991 | Nobileau | |
| 5,044,438 | A | * | 9/1991 | Young | 166/382 |
| 5,163,514 | A | * | 11/1992 | Jennings | 166/368 |
| 5,236,037 | A | * | 8/1993 | Watkins | 166/89.1 |
| 5,360,063 | A | | 11/1994 | Henderson, Jr. | |
| 6,003,602 | A | | 12/1999 | Wilkins | |
| 6,179,053 | B1 | * | 1/2001 | Dallas | 166/77.51 |
| 6,293,345 | B1 | * | 9/2001 | Watkins | 166/368 |
| 6,408,947 | B1 | * | 6/2002 | Cunningham et al. | 166/339 |
| 6,516,861 | B2 | * | 2/2003 | Allen | 166/351 |
| 6,571,877 | B1 | * | 6/2003 | Van Bilderbeek | 166/339 |
| 6,805,200 | B2 | * | 10/2004 | DeBerry | 166/347 |
| 6,966,381 | B2 | | 11/2005 | Stjernstrom et al. | |
| 6,988,553 | B2 | * | 1/2006 | DeBerry | 166/347 |
| 7,013,970 | B2 | * | 3/2006 | Collie et al. | 166/89.1 |
| 7,028,777 | B2 | * | 4/2006 | Wade et al. | 166/343 |
| 7,467,663 | B2 | * | 12/2008 | Reimert | 166/344 |
| 7,740,061 | B2 | * | 6/2010 | Van Bilderbeek et al. | 166/96.1 |
| 7,743,824 | B2 | * | 6/2010 | Lam et al. | 166/177.5 |
| 7,770,650 | B2 | * | 8/2010 | Young et al. | 166/344 |
| 8,074,724 | B2 | * | 12/2011 | Minassian et al. | 166/382 |
| 8,322,441 | B2 | * | 12/2012 | Fenton | 166/368 |
| 8,561,705 | B2 | * | 10/2013 | Wilson | 166/336 |
| 8,727,012 | B2 | * | 5/2014 | Bhat | 166/338 |
| 8,739,883 | B2 | * | 6/2014 | Aarnes et al. | 166/368 |
| 2003/0121667 | A1 | * | 7/2003 | Massie et al. | 166/344 |
| 2003/0234109 | A1 | * | 12/2003 | Marroquin et al. | 166/348 |
| 2004/0200614 | A1 | | 10/2004 | Stjernstrom et al. | |
| 2005/0051337 | A1 | | 3/2005 | Jennings et al. | |
| 2011/0214884 | A1 | * | 9/2011 | Faanes et al. | 166/382 |

* cited by examiner

BORE PROTECTOR

FIELD OF THE INVENTION

The present invention relates to drilling for and production of hydrocarbons from subsea located wells. More specifically, the invention relates to drilling through existing production wells without retrieving existing production tubing. The invention provides a bore protector for a tubing hanger, for use whilst undertaking through tubing rotary drilling (TTRD).

BACKGROUND OF THE INVENTION AND PRIOR ART

Some subsea production trees (Xmas tree), such as horizontal production trees, have a vertical bore into which operations such as wireline operations and further drilling can be undertaken. A recent technology is called through tubing rotary drilling (TTRD), for which further drilling is undertaken in an existing production well without retrieving the existing production tubing. TTRD provides significant savings, making old wells viable for further production. However, the tubing hanger comprises sealing surfaces for plugs that are inserted and activated in order to close the tubing hanger bore sealingly during production, and said sealing surfaces are vulnerable to damage during drilling operations. Said seals are metal to metal seals, and they are critical in order to avoid leakage of hydrocarbons to the environment during production.

So far no acceptable technology exists providing protection of the tubing hanger sealing surfaces, whilst providing easy testing and maintenance.

Some general bore protectors exist for use at other locations, but they are not possible to modify to function as tubing hanger bore protectors because of much larger and simpler geometry and far less demanding or very different functional requirements. Examples on existing general bore protectors are found in patent publications WO 2006103477, relating to a downhole bore protector, and U.S. Pat. No. 6,003,602A, relating to a bore protector of about 18,75" for conventional drilling and completion. However, more relevant bore protectors are described in the patent publications US 2004/0200614 A1/U.S. Pat. Nos. 6,966,381 and 3,231,93 B1. But the solution of US 2004/0200614 A1 requires a test sleeve and do not provide sufficient protection of the vulnerable seal surfaces, and the solution of U.S. Pat. No. 3,231,93 requires a transition pipe, all of the sealing surfaces may not be protected, testing is not convenient, neither is it adapted for hanging up of a drill string.

A demand exists for a bore protector for protecting a tubing hanger bore in a production Xmas tree, and the objective of the present invention is to provide a bore protector having the required functionality.

SUMMARY OF THE INVENTION

The invention provides a bore protector for a tubing hanger, the bore protector is to be arranged in a tubing hanger in a spool in a subsea production Xmas tree for through tubing rotary drilling (TTRD) in an existing production well. The bore protector is distinctive in that it comprises

- a means to be releasably fastened in at least one of: the spool in the Xmas tree and the tubing hanger, and
- a wear sleeve extending down into the tubing hanger, covering the tubing hanger sealing surfaces for the tubing hanger plugs.

Preferably, the wear sleeve comprises a shoulder at or near an upper end, the shoulder is arranged on a below positioned seat of a main part of the bore protector, in which position the wear sleeve is releasably fastened.

The wear sleeve is preferably releasably fastened with bolts to a below positioned seat of a main part or main body of the bore protector, for facilitating replacement of the wear sleeve. Alternatively, the releasable fastening is by other feasible mechanisms and arrangements, for example an above the wear sleeve positioned split lock ring or bolts arranged in a radial outward direction instead of a downward direction from the wear sleeve to the main part or body.

The bore protector is a sleeve-like construction with outside geometry small enough to fit inside the spool bore or tubing hanger and an inside bore large enough to allow preparations for and performance of TTRD down through the bore protector whilst protecting the tubing hanger sealing surfaces. Said dimensional limitations are intended to be implicit by the preamble of claim 1.

The bore protector preferably is a sleeve assembly with outer geometry small enough to be installed with a BOP (Blow Out Preventer) connected to the Xmas tree, which means that installation is down through a riser and down through the subsea BOP. The releasable fastening is preferably to the spool bore, but it can be to the tubing hanger or to both the spool bore and tubing hanger. Preferably the bore protector has geometry for hanging up the weight of the bore protector on the tubing hanger, after which the releasable locking is effected. The locking is preferably to the Xmas tree inner bore surface, but alternatively or in addition locking can be to the tubing hanger. Preferably, the locking means comprises means for both axial and rotational locking, such as a split lock ring that is expandable for locking to the spool bore and radial anti-rotation locking keys or similar. The locking means preferably comprises tensioning or pre-tensioning elements, such as springs. The locking means are preferably operated by axial and/or radial and/or rotational movement of the bore protector or elements of the bore protector.

Preferably the bore protector comprises a seat or a shoulder or similar for hanging up the drill string, which is a big advantage with respect to safety when drilling, as a drilling emergency disconnection for example due to severe weather becomes much faster. The geometry of such seat is adapted to match the geometry of a hang up device that is attached to the drill string.

The bore protector preferably comprises means for facilitating pressure testing, preferably comprising seal elements and/or seats functioning to reduce the volume required to pressurise for said pressure testing. Several connections or seals require testing, such as the seal in the connection between the Xmas tree and the BOP and seals of the BOP stack.

Preferably, the geometry and dimension of the outer structure of the bore protector is adapted to standard Xmas tree geometry and dimension. Preferably the lower part of the wear sleeve is adapted to the individual tubing hanger geometry and dimension as well as the drilling and downhole equipment. Accordingly, most of the bore protector parts can be standardized whilst the easily replaceable wear sleeve can be the only part that must be adapted to the tubing hanger of the individual well.

Preferably the wear sleeve comprises a wear indicator. The wear indicator can be a sensor or an ultrasound or electromagnetic based wear sleeve thickness measurement transmitter or it can be a visible indication easily readable by wireline operations or it can be based on embedded optical fibers.

The invention also provides use of a bore protector according to the invention, for protecting the tubing hanger sealing surfaces for the tubing hanger plugs when performing through tubing rotary drilling.

FIGURES

Figure 2:
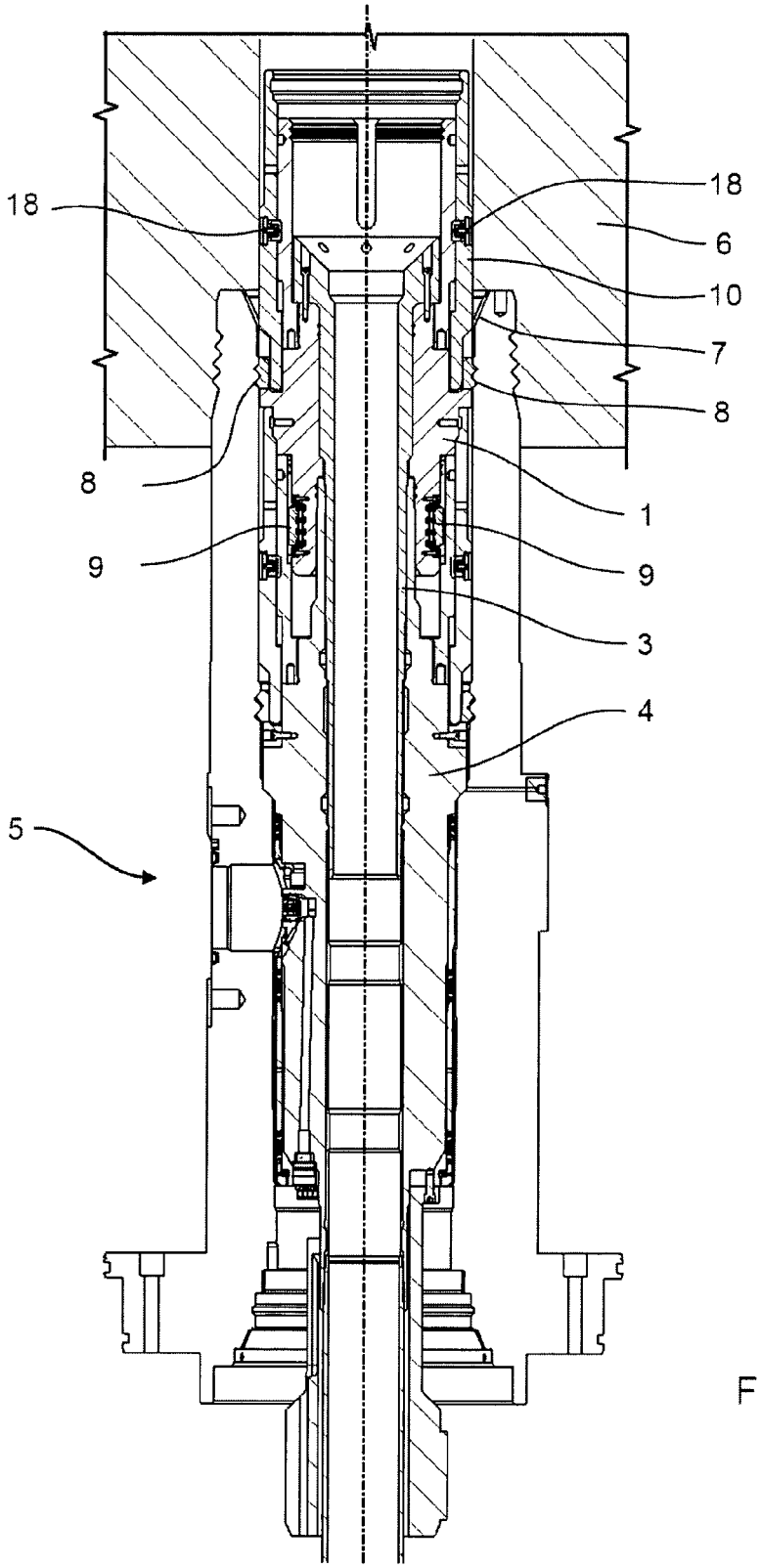
Figure 3:
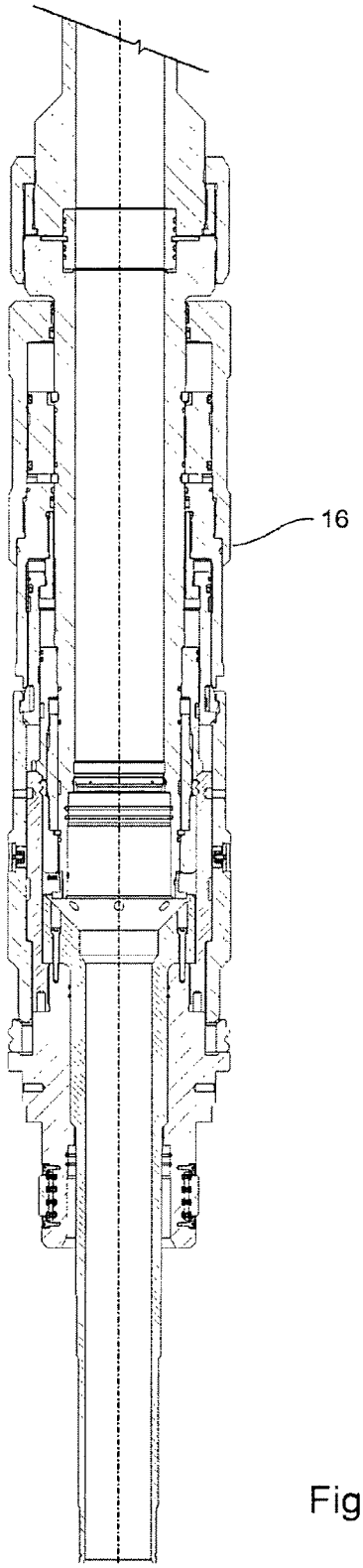
Figure 4:
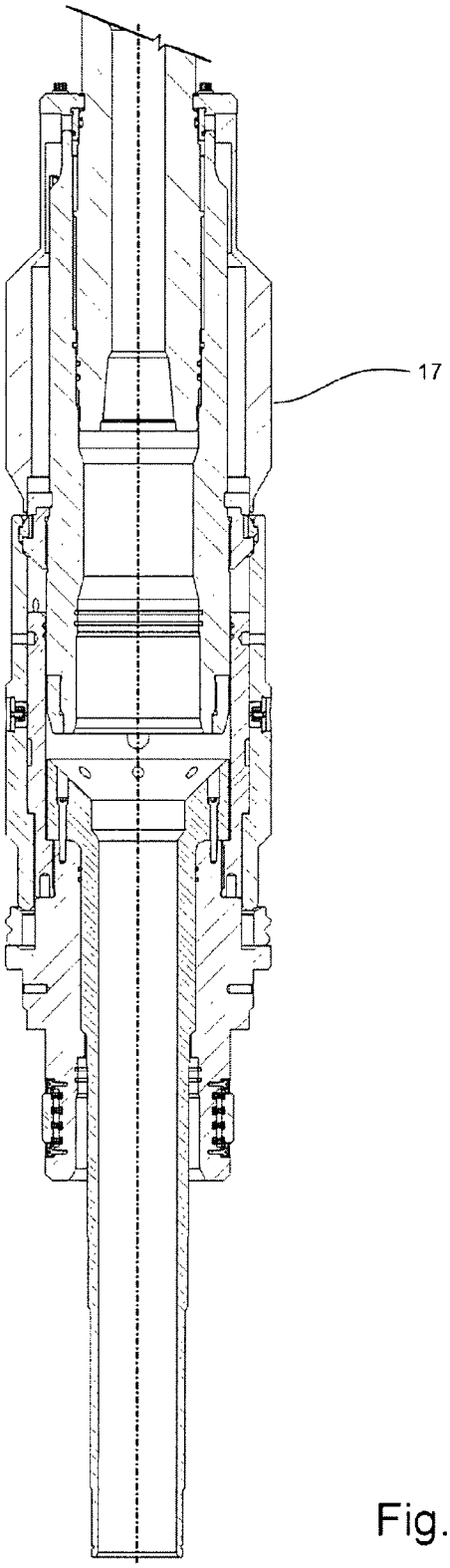

The invention is illustrated with four figures, of which:

FIG. 1 illustrates an embodiment of a bore protector according to the invention, in longitudinal section, FIG. 2 illustrates, in longitudinal section, a bore protector of the invention as landed and locked on top of a tubing hanger in a Xmas tree, with a BOP also installed, FIG. 3 illustrates installation or retrieval of a bore protector of the invention, with a tubing hanger running tool, and FIG. 4 illustrates installation or retrieval of a bore protector of the invention, with a mechanical recovery tool.

DETAILED DESCRIPTION

Reference is made to FIG. 1, illustrating a bore protector 1 of the invention, the bore protector is to be arranged in a spool in a subsea production Xmas tree after a subsea blow out preventer (BOP) is arranged on top of the Xmas tree for through tubing rotary drilling (TTRD) in an existing production well. More specifically, only the bore protector 1 is illustrated, in longitudinal section. The bore protector comprises means 2 to be releasably fastened in at least one of: the spool in the Xmas tree and the tubing hanger. The bore protector comprises a wear sleeve 3 extending down into the tubing hanger, when the bore protector is in operative position, covering the tubing hanger sealing surfaces for the tubing hanger plugs.

Reference is also made to FIG. 2 illustrating, in longitudinal section, a bore protector 1 of the invention as landed and locked on top of a tubing hanger 4 in a Xmas tree 5, i.e. a Xmas tree spool, with a BOP 6 installed on top. This assembly is ready for through tubing rotary drilling (TTRD). An environmental seal 7 (in the illustrated embodiment a VX seal) provides a fluid tight barrier between the Xmas tree spool and BOP. An expandable split locking ring 8 is in expanded position, thereby locking the bore protector to the Xmas tree bore. In FIG. 1, the split lock ring 8 (i.e. a locking means 2) is illustrated in unlocked, non-expanded position. Also anti rotation keys 9, also called locking dogs, are in expanded position, providing rotational locking of the bore protector. The locking means 2, i.e. split lock ring 8 and anti rotation keys 9 in the illustrated embodiment of the bore protector, are preferably controlled by axial movement of a sleeve element and/or rotation. In the illustrated embodiment axial movement of an actuator sleeve 10 controls the split lock ring 8. When in locked position, latch dogs 18 lathes into position in latching grooves, thereby keeping the actuator sleeve 10 in locked position. The wear sleeve 3 is releasably fastened with bolts 11 to a main body 12 of the bore protector 1. The bore protector 1 comprises a seat or a shoulder 13 for hanging up the drill string. The bore protector also comprises one or more shoulders 19 for landing and resting on the tubing hanger. The bore protector comprises seal elements 14*a*, 14*b*, functioning to reduce the volume required to pressurise when pressure testing the environmental barrier seal 7, the VX seal, between the Xmas tree and BOP, and a seal seat 14*c* for a seal on a pressure testing tool. Further, the bore protector comprises a wear indicator 15.

FIG. 3 illustrates installation or retrieval of a bore protector of the invention, with a tubing hanger running tool 16. More specifically, the existing tubing hanger running tool 16 used to retrieve and install the tubing hanger in the production well is used also for installation and retrieval of the bore protector. The tubing hanger running tool has a releasable fastening to and is able to move the actuator sleeve 10 axially in order to lock or unlock the bore protector to the spool.

FIG. 4 illustrates an alternative tool for installation or retrieval of a bore protector of the invention, namely a mechanical recovery tool 17. Also fishing tools able to or modified to lift the bore protector and operate the locking and unlocking means of the bore protector through the riser and BOP can be used for installation and retrieval of the bore protector of the invention.

The bore protector of the invention can comprise features as described or illustrated here in any operative combination, which combinations are embodiments of the invention.

The invention claimed is:

1. A bore protector arranged in a tubing hanger within a spool of a subsea production Xmas tree for through tubing rotary drilling (TTRD) in an existing production well, the bore protector comprising:

a means to be releasably fastened in at least one of: the spool of the Xmas tree and the tubing hanger; and a wear sleeve extending down into the tubing hanger, covering tubing hanger sealing surfaces for tubing hanger plugs, the wear sleeve comprising a shoulder at or near an upper end, the shoulder arranged on a below positioned seat of a main part of the bore protector, in which position the wear sleeve shoulder is releasably fastened to the seat.

2. The bore protector according to claim 1, wherein the bore protector comprises a split lock ring that is expandable for locking to a spool bore.

3. The bore protector according to claim 1, wherein the wear sleeve is releasably fastened with bolts to a main part of the bore protector.

4. The bore protector according to claim 1, wherein the bore protector comprises a seat or a shoulder for hanging up a drill string.

5. The bore protector according to claim 1, comprising means for facilitating pressure testing, the means for facilitating comprising at least one of seal elements and seats functioning to reduce a volume required to pressurise for said pressure testing.

6. The bore protector according to claim 1, wherein a geometry and a dimension of an outer structure is adapted to standard Xmas tree geometry and dimension.

7. The bore protector according to claim 1, wherein a geometry and a dimension of a lower part of the wear sleeve is adapted to a geometry and a dimension of the tubing hanger.

8. The bore protector according to claim 1, wherein the wear sleeve comprises a wear indicator.

9. Use of a bore protector according to claim 1, for protecting the tubing hanger sealing surfaces for the tubing hanger plugs when performing through tubing rotary drilling.

* * * * *